United States Patent [19]

Sakurai

[11] Patent Number: 4,667,075

[45] Date of Patent: May 19, 1987

[54] MICROWAVE OVEN FOR VEHICLES

[75] Inventor: Takashi Sakurai, Nagoya, Japan

[73] Assignee: Nippondenso Co., Ltd., Kariya, Japan

[21] Appl. No.: 828,670

[22] Filed: Feb. 12, 1986

[30] Foreign Application Priority Data

Feb. 13, 1985 [JP] Japan ..... 60-25498

[51] Int. Cl.[4] ..... H05B 6/66

[52] U.S. Cl. ..... 219/10.55 B; 219/10.55 R; 363/101

[58] Field of Search ..... 219/10.55 B, 10.55 R; 363/101, 126, 90

[56] References Cited

U.S. PATENT DOCUMENTS

| | | | |
|---|---|---|---|
| 2,834,931 | 5/1958 | Walker | 363/101 |
| 3,270,270 | 8/1966 | Yenisey | 363/101 X |
| 3,530,358 | 9/1970 | Thompson | 363/101 X |

OTHER PUBLICATIONS

Puschner, "Heating with Microwaves–Fundamentals, Components and Circuit Technique", Philips Technical Library, 1966, pp. 50–51, 64–65.

Niu et al, "Power Control of Domestic Microwave Ovens by Switching in the High-Voltage Circuitry", Journal of Microwave Power, 13(2), 1978, pp. 193–197.

*Primary Examiner*—Philip H. Leung

*Attorney, Agent, or Firm*—Cushman, Darby & Cushman

[57] ABSTRACT

A microwave oven for a camping or other vehicle includes a heating room in which an object is heating by applying microwaves thereto, a microwave guide to propagate the microwaves into the heating room, a magnetron to produce the microwave for the microwave guide, and a voltage supply device to supply the magnetron with an appropriate voltage. The voltage supply device includes a transformer to boost the three-phase AC voltage from an alternator mounted on the vehicle, and a rectifying circuit to rectify the three-phase AC voltage boosted by the transformer. The magnetron receives the voltage rectified. The heater terminal and other main terminal of the magnetron are connected to terminals of the battery mounted on the vehicle.

4 Claims, 2 Drawing Figures

MICROWAVE OVEN FOR VEHICLES

BACKGROUND OF THE INVENTION

The present invention relates to a microwave oven suitable for use on a camping or other vehicle.

In the past, domestic microwave ovens, operating on 100 volts AC, have been used on vehicles as shown in FIG. 1.

In FIG. 1, alternator 10 is driven by an engine mounted on the vehicle and produces three-phase alternating current. Diodes 12*a*, 12*b*, 12*c*, 12*d*, 12*e*, and 12*f* of rectifying circuit 12 rectify the three-phase alternating current from alternator 10 to charge battery 14.

DC/AC converter 20 is connected to battery 14 and supplies domestic microwave oven 45 with 100 volts AC. Domestic microwave oven 45 includes a transformer 22. A leakage choke coil 24 is connected to secondary winding 22*b* of transformer 22 to limit electric current therethrough. A rectifying circuit 26, connected to choke coil 24 supplies energy to a magnetron 28. A microwave guide 36 propagates microwaves radiated from an antenna 35 of magnetron 28. A heating room 40 heats an object 42 by applying microwaves thereto.

Thus, the conventional system has domestic microwave oven 45 mounted on the vehicle as it is. As a result, efficiency is reduced because the alternating current from alternator 10 is converted to direct current and converted again to alternating current by DC/AC converter 20.

SUMMARY OF THE INVENTION

It is a primary object of this invention to provide a microwave oven which is arranged for use on a vehicle by directly using the three-phase alternating current generated by an alternator for energizing a magnetron.

It is a further object to provide a microwave oven in which the leakage choke coil provided in domestic microwave ovens is not needed.

It is a further object to provide a microwave oven on a vehicle in which ripple on the voltage applied to a magnetron thereof is small so that the magnetron can work efficiently.

According to the present invention, a magnetron for a microwave oven is supplied with voltage from boosting means for boosting the three-phase alternating current voltage from an alternator. The boosted voltage is then rectified and supplied to the positive terminal of the magnetron.

BRIEF DESCRIPTION OF THE DRAWINGS

These and other objects and advantages of this invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

The present invention will now be described hereinunder with reference to the preferred embodiments thereof.

Figure 1:
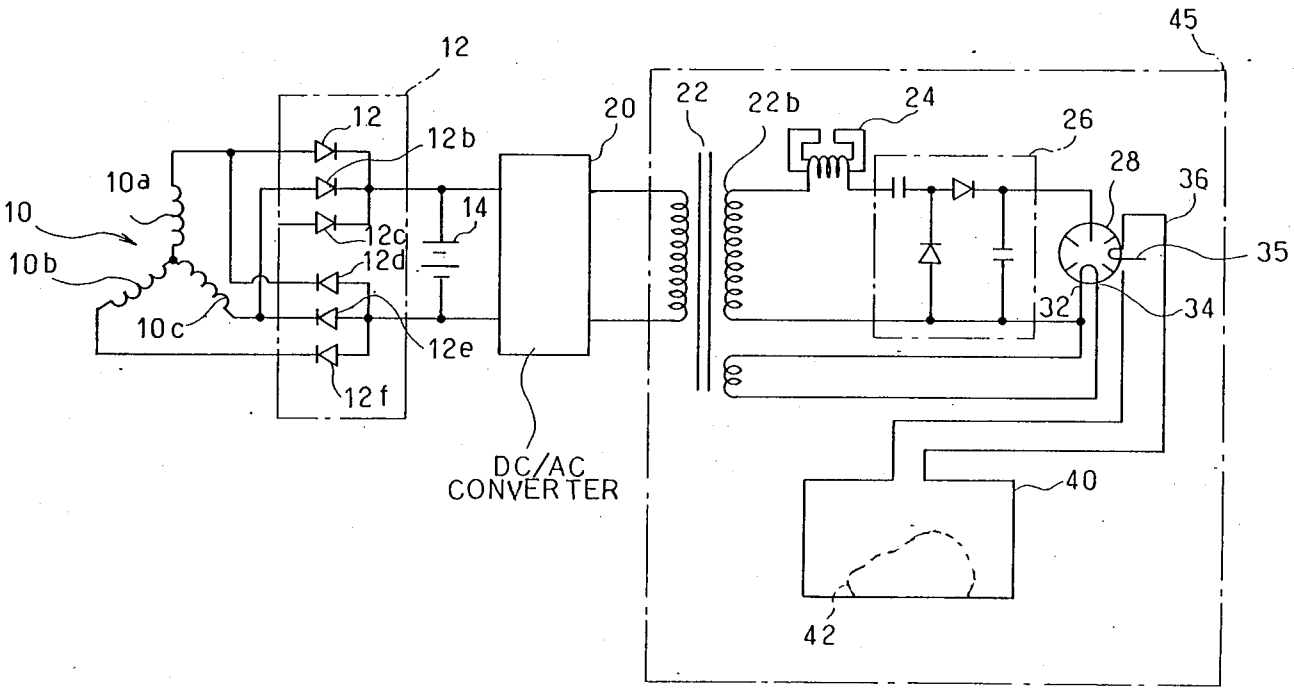
FIG. 1 (PRIOR ART)
FIG. 1 is an electric wiring diagram showing a conventional system.
Figure 2:
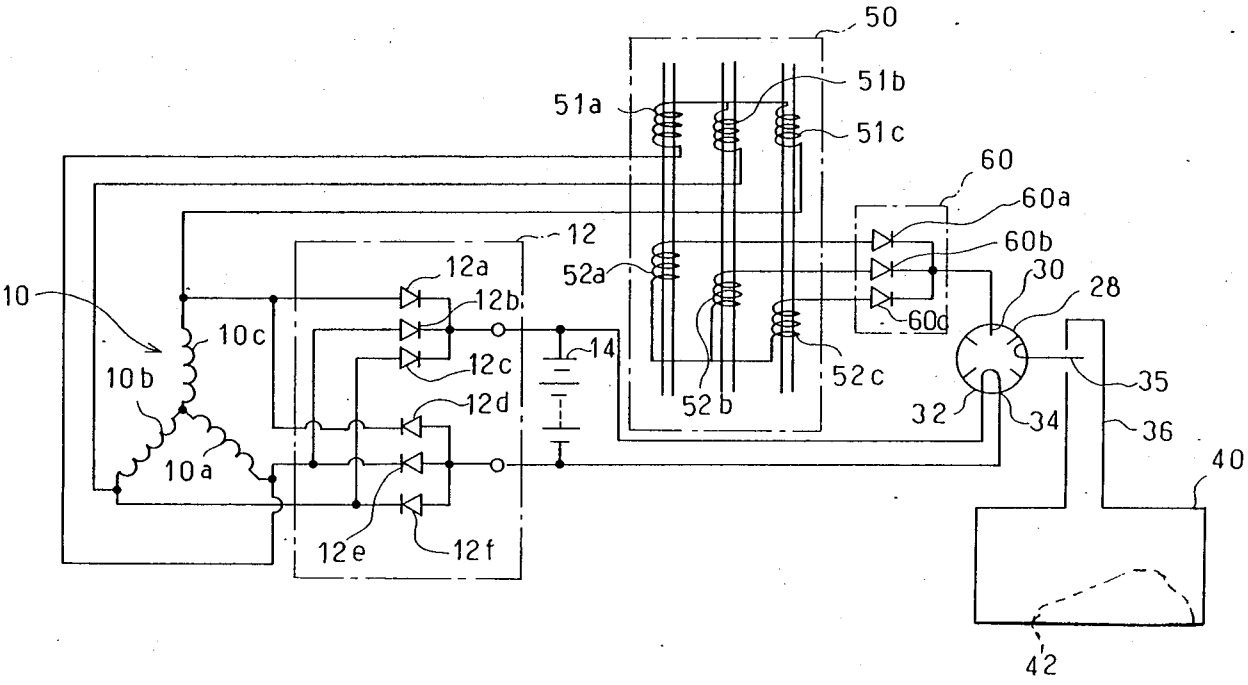
FIG. 2 is an electric wiring diagram showing an embodiment according to the present invention.

FIG. 2 is an electric wiring diagram showing an embodiment according to the present invention. In FIG. 2, armature windings 10*a*, 10*b*5 and 10*c* of alternator 10 are respectively connected to first windings 51*a*, 51*b*, and 51*c* of a transformer 50. Second windings 52*a*, 52*b*, and 52*c* are respectively connected to diodes 60*a*, 60*b*, and 60*c* which constitute a rectifying circuit 60. The output terminal of rectifying circuit 60 is connected to positive terminal 30 of magnetron 28. Heater terminal 32 and negative terminal 34 of magnetron 28 are respectively connected to the positive and negative terminals of battery 14.

In the above-described embodiment, the three-phase AC voltage generated by alternator 10 is boosted by transformer 50 to a voltage which is enough to drive magnetron 28. The boosted three-phase AC voltage is rectified by rectifying circuit 60. Magnetron 28 receives the rectified voltage at positive terminal 30 and receives the voltage of battery 14 at heater terminal 32, thereby allowing antenna 35 to propagate microwaves in microwave guide 36. Object 42 in heating room 40 is heated by the microwaves from microwave guide 36.

It should be noted that since the voltage applied to positive terminal 30 of magnetron 28 is a rectified three-phase AC voltage and not a rectified single-phase AC voltage as in a conventional domestic microwave oven, ripple on the voltage applied to positive terminal 30 is small, so that magnetron 28 can work efficiently.

Furthermore, since the current produced by alternator 10, which is used as the power source for magnetron 28, is almost constant even if the rotating speed of the engine varies, it is not necessary to use the leakage choke coil as in the conventional domestic microwave oven.

In another embodiment, a reduced voltage from rectifying circuit 60 can be applied to heater terminal 32 of magnetron 28 instead of applying the voltage from battery 14 thereto.

Although only a few exemplary embodiments of this invention have been described in detail above, those skilled in the art will readily appreciate that many modifications are possible in the preferred embodiments without materially departing from the novel teachings and advantages of this invention. Accordingly, all such modifications are intended to be included within the scope of this invention as defined by the following claims.

What is claimed is:

1. A microwave oven with power suppply for a vehicle comprising:

a vehicle alternator to generate a three-phase AC voltage;

boosting means, connected to said vehicle alternator, for receiving said three-phase voltage from said alternator and boosting said three-phase voltage to produce boosted three-phase voltage;

rectifying means, connected to said boosting means, for rectifying said boosted three-phase voltage for said boosting means;

a magnetron, receiving said voltage rectified by said rectifying means and producing microwaves therefrom; and a chamber;

means for directing said microwaves to an object to be heated in said chamber.

2. A microwave oven with power supply according to claim 1, further including a battery and means for charging said battery with said alternator and said magnetron has first, second and heater terminals, said voltage recitified by said rectifying means being applied to said first terminal, said second terminal of said magnetron being connected to said battery and said heater terminal of said magnetron being connected to said battery.

3. A microwave oven according to claim 1, wherein said boosting means comprises a transformer having first windings connected to armature windings of said alternator, respectively.

4. A microwave oven according to claim 3, wherein said rectifying means comprises three diodes, respectively, connected to second windings of said transformer, output terminals of said diodes being connected to each other and to said magnetron.

* * * * *